US009968982B2

(12) United States Patent
Dunwoody et al.

(10) Patent No.: US 9,968,982 B2
(45) **Date of Patent: *May 15, 2018**

(54) HIGH SPEED NECKING CONFIGURATION

(71) Applicant: Crown Packaging Technology, Inc., Alsip, IL (US)

(72) Inventors: Paul Robert Dunwoody, Oxon (GB); Ian K. Scholey, Barnsley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 77 days.

This patent is subject to a terminal disclaimer.

(21) Appl. No.: 15/088,691

(22) Filed: Apr. 1, 2016

(65) Prior Publication Data

US 2016/0214164 A1 Jul. 28, 2016

Related U.S. Application Data

(63) Continuation of application No. 14/070,954, filed on Nov. 4, 2013, now Pat. No. 9,308,570, which is a continuation of application No. 12/109,176, filed on Apr. 24, 2008, now Pat. No. 8,601,843.

(51) Int. Cl.
*B21D 51/26* (2006.01)

(52) U.S. Cl.
CPC ..... *B21D 51/2638* (2013.01); *B21D 51/2615* (2013.01); *B21D 51/2692* (2013.01)

(58) Field of Classification Search
CPC ..... B21D 51/2638; B21D 51/2615; B21D 51/2692
See application file for complete search history.

(56) References Cited

U.S. PATENT DOCUMENTS

| | | | |
|---|---|---|---|
| 137,400 | A | 4/1873 | Ahrend |
| 548,888 | A | 10/1895 | Noteman |
| 593,755 | A | 11/1897 | Pond et al. |
| 1,459,584 | A | 6/1923 | Ericsson |
| 1,498,940 | A | 6/1924 | Wheeler |
| 1,621,301 | A | 3/1927 | Wright |
| 2,467,278 | A | 4/1949 | Thompson |
| 2,550,156 | A | 4/1951 | Lyon |
| 2,686,551 | A | 8/1954 | Laxo |

(Continued)

FOREIGN PATENT DOCUMENTS

| | | |
|---|---|---|
| CA | 2536841 | 3/2005 |
| DE | 1939623 | 2/1970 |

(Continued)

*Primary Examiner* — Teresa M Ekiert
(74) *Attorney, Agent, or Firm* — Baker & Hostetler LLP

(57) ABSTRACT

A horizontal can necking machine assembly includes a plural of main turrets and a plural of transfer starwheels. Each main turret includes a main turret shaft, a main gear mounted on the main turret shaft, a pusher assembly, and a die capable of necking a can body upon actuation of the turret shaft. Each transfer starwheel includes a transfer shaft and a transfer gear mounted on the transfer shaft. The main gears are engaged with the transfer gears such that lines through the main gear center and the centers of opposing transfer gears form an included angle of less than 170 degrees, thereby increasing the angular range available for necking the can body. The main turrets and transfer starwheels may operate to neck and move at least 2800 cans per minute, and each pusher assembly may have a stroke length relative to the die that is at least 1.5 inches.

26 Claims, 10 Drawing Sheets

(56) References Cited

U.S. PATENT DOCUMENTS

| | | | |
|---|---|---|---|
| 2,874,562 | A | 2/1959 | Cross |
| 2,928,454 | A | 3/1960 | Laxo |
| 2,940,502 | A | 6/1960 | La Martine Francis |
| 3,096,709 | A | 7/1963 | Eldred et al. |
| 3,143,366 | A | 8/1964 | Nichols |
| 3,268,054 | A | 8/1966 | Murphy et al. |
| 3,344,685 | A | 10/1967 | Crouzet |
| 3,374,684 | A | 3/1968 | Greven |
| 3,406,648 | A | 10/1968 | Armbruster |
| 3,418,837 | A | 12/1968 | Vanderlaan et al. |
| 3,599,780 | A | 8/1971 | Sorbie |
| 3,621,530 | A | 11/1971 | Pflieger et al. |
| 3,635,069 | A | 1/1972 | Eickenhorst |
| 3,659,443 | A | 5/1972 | Ball |
| 3,687,098 | A | 8/1972 | Maytag |
| 3,786,957 | A | 1/1974 | Hilgenbrink |
| 3,797,429 | A | 3/1974 | Wolfe |
| 3,812,696 | A | 5/1974 | Kneusel et al. |
| 546,631 | A | 2/1976 | Traczyk et al. |
| 3,964,412 | A | 6/1976 | Kitsuda |
| 3,983,729 | A | 10/1976 | Traczyk et al. |
| 4,030,432 | A | 6/1977 | Miller et al. |
| 4,164,997 | A | 8/1979 | Mueller |
| 4,261,193 | A | 4/1981 | Boik |
| 4,341,103 | A | 7/1982 | Escallon et al. |
| 4,446,714 | A | 5/1984 | Cvacho |
| 4,457,160 | A | 7/1984 | Wunsch |
| 4,513,595 | A | 4/1985 | Cvacho |
| 4,519,232 | A | 5/1985 | Traczyk et al. |
| 4,576,024 | A | 3/1986 | Weber |
| 4,590,788 | A | 5/1986 | Wallis |
| 4,624,098 | A | 11/1986 | Trendel |
| 4,671,093 | A | 6/1987 | Dominico et al. |
| 4,693,108 | A | 9/1987 | Traczyk et al. |
| 4,732,027 | A | 3/1988 | Traczyk et al. |
| 4,773,250 | A | 9/1988 | Miyazaki |
| 4,774,839 | A | 10/1988 | Caleffi et al. |
| 4,817,409 | A | 4/1989 | Bauermeister |
| 4,838,064 | A | 6/1989 | Pass |
| 4,892,184 | A | 1/1990 | Vander Griendt et al. |
| 4,945,954 | A | 8/1990 | Wehrly et al. |
| 5,105,649 | A | 4/1992 | Hite et al. |
| 5,209,101 | A | 5/1993 | Finzer |
| 5,226,303 | A | 7/1993 | Dieden et al. |
| 5,235,839 | A | 8/1993 | Lee, Jr. et al. |
| 5,245,848 | A | 9/1993 | Lee, Jr. et al. |
| 5,282,375 | A | 2/1994 | Lee, Jr. et al. |
| 5,297,414 | A | 3/1994 | Sainz |
| 5,349,836 | A | 9/1994 | Lee, Jr. |
| 5,353,619 | A | 10/1994 | Chu et al. |
| 5,370,472 | A | 12/1994 | Muellenberg |
| 5,467,628 | A | 11/1995 | Bowlin et al. |
| 5,469,729 | A | 11/1995 | Hager |
| 5,497,900 | A | 3/1996 | Caleffi et al. |
| 5,540,320 | A | 7/1996 | Sarto et al. |
| 5,553,826 | A | 9/1996 | Schultz |
| 5,611,231 | A | 3/1997 | Marritt et al. |
| 5,634,364 | A | 6/1997 | Gardner et al. |
| 5,676,006 | A | 10/1997 | Marshall |
| 5,713,235 | A | 2/1998 | Diekhoff |
| 5,724,848 | A | 3/1998 | Aschberger |
| 5,755,130 | A | 5/1998 | Tung et al. |
| 5,782,308 | A | 7/1998 | Latten et al. |
| 5,882,178 | A | 3/1999 | Hudson et al. |
| 5,906,120 | A | 5/1999 | Thacker et al. |
| 6,032,502 | A | 3/2000 | Halasz et al. |
| 6,055,836 | A | 5/2000 | Waterworth et al. |
| 6,085,563 | A | 7/2000 | Heiberger et al. |
| 6,094,961 | A | 8/2000 | Aschberger |
| 6,164,109 | A | 12/2000 | Bartosch |
| 6,167,743 | B1 | 1/2001 | Marritt et al. |
| 6,176,006 | B1 | 1/2001 | Milliman |
| 6,178,797 | B1 | 1/2001 | Marshall et al. |
| 6,199,420 | B1 | 3/2001 | Bartosch |
| 6,240,760 | B1 | 6/2001 | Heiberger et al. |
| 6,571,986 | B1 | 6/2003 | Simmons |
| 6,644,083 | B2 | 11/2003 | Pakker |
| 6,658,913 | B1 | 12/2003 | Zanzerl et al. |
| 6,661,020 | B2 | 12/2003 | Schill et al. |
| 6,672,122 | B2 | 1/2004 | Mustread et al. |
| 6,698,265 | B1 | 3/2004 | Thomas |
| 6,752,000 | B2 | 6/2004 | Reynolds et al. |
| 6,779,651 | B1 | 8/2004 | Linglet et al. |
| 7,028,857 | B2 | 4/2006 | Peronek |
| 7,069,765 | B2 | 7/2006 | Grove et al. |
| 7,100,417 | B2 | 9/2006 | Yamanaka et al. |
| 7,770,425 | B2 | 8/2010 | Egerton et al. |
| 7,784,319 | B2 | 8/2010 | Saville |
| 7,963,139 | B2 | 6/2011 | Shortridge |
| 8,245,551 | B2 | 8/2012 | Egerton |
| 8,464,567 | B2 | 6/2013 | Saville |
| 2002/0029599 | A1 | 3/2002 | Heiberger |
| 2002/0148266 | A1 | 10/2002 | Heiberger et al. |
| 2004/0069027 | A1 | 4/2004 | Fukushima |
| 2005/0193796 | A1 | 9/2005 | Heiberger et al. |
| 2006/0101884 | A1 | 5/2006 | Schill et al. |
| 2006/0101885 | A1 | 5/2006 | Schill et al. |
| 2006/0101889 | A1 | 5/2006 | Schill et al. |
| 2006/0104745 | A1 | 5/2006 | Schill et al. |
| 2007/0227218 | A1 | 10/2007 | Shortridge |
| 2007/0227320 | A1 | 10/2007 | Marshall |
| 2007/0227859 | A1 | 10/2007 | Marshall et al. |
| 2007/0249424 | A1 | 10/2007 | Marshall et al. |
| 2007/0251803 | A1 | 11/2007 | Schill et al. |
| 2007/0283544 | A1 | 12/2007 | Schill et al. |
| 2007/0283665 | A1 | 12/2007 | Schill et al. |
| 2008/0034823 | A1 | 2/2008 | Frattini et al. |

FOREIGN PATENT DOCUMENTS

| | | |
|---|---|---|
| DE | 10156085 | 5/2003 |
| EP | 0349521 | 1/1990 |
| EP | 0537772 | 4/1993 |
| EP | 0885076 | 7/2002 |
| FR | 2876305 | 4/2006 |
| FR | 2881123 | 7/2006 |
| GB | 2173437 | 10/1986 |
| GB | 189707306 | 3/1989 |
| JP | 05305373 | 11/1993 |
| JP | 2002/102968 | 4/2002 |
| JP | 2003/237752 | 8/2003 |
| JP | 2003/251424 | 9/2003 |
| JP | 2003/252321 | 9/2003 |
| JP | 2003/320432 | 11/2003 |
| JP | 2004/002557 | 1/2004 |
| JP | 2004/130386 | 4/2004 |
| JP | 2004/160468 | 6/2004 |
| JP | 2004/217305 | 8/2004 |
| JP | 2005/022663 | 1/2005 |
| JP | 2006/176140 | 7/2006 |
| JP | 2006/176183 | 7/2006 |
| WO | WO 94/12412 | 6/1994 |
| WO | WO 97/37786 | 10/1997 |
| WO | WO 97/49509 | 12/1997 |
| WO | WO 00/23212 | 4/2000 |
| WO | WO 2006/055185 | 5/2006 |
| WO | WO 2006/067207 | 6/2006 |
| WO | WO 2006/067901 | 6/2006 |
| WO | WO 2006/095215 | 9/2006 |

HIGH SPEED NECKING CONFIGURATION

CROSS REFERENCE TO RELATED APPLICATIONS

This application is a continuation of application Ser. No. 14/070,954, filed Nov. 4, 2013 which is a continuation of application Ser. No. 12/109,176, filed Apr. 24, 2008, now U.S. Pat. No. 8,601,843, and is related by subject matter to the inventions disclosed in the following commonly assigned applications: U.S. patent application Ser. No. 12/109,031, filed on Apr. 24, 2008 and entitled "Apparatus For Rotating A Container Body", now issued U.S. Pat. No. 7,997,111, U.S. patent application Ser. No. 12/108,950 filed on Apr. 24, 2008 and entitled "Adjustable Transfer Assembly For Container Manufacturing Process", now U.S. Pat. No. 8,245,551, U.S. patent application Ser. No. 12/109,058, filed on Apr. 24, 2008 and entitled "Distributed Drives for A Multi-Stage Can Necking Machine", now U.S. Pat. No. 8,464,567, U.S. patent application Ser. No. 12/108,926, filed on Apr. 24, 2008 and entitled "Container Manufacturing Process Having Front-End Winder Assembly", now U.S. Pat. No. 7,770,425, and U.S. patent application Ser. No. 12/109,131, filed on Apr. 24, 2008 and entitled "Systems And Methods For Monitoring And Controlling A Can Necking Process," now U.S. Pat. No. 7,784,319. The disclosure of each application is incorporated by reference herein in its entirety.

FIELD OF THE TECHNOLOGY

The present technology relates to a multi-stage can necking machine. More particularly, the present technology relates to a horizontal multi-stage can necking machine configured for high speed operations.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2\frac{11}{16}^{th}$ inches to $2\frac{6}{16}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer starwheel shaft that carries a starwheel to transfer cans between turret starwheels.

Multi-stage can necking machines are limited in speed. Typically, commercial machines run at a rate of 1200-2500 cans per minute. While this is a high rate, there is a constant need to produce more and more cans per minute.

Also, concentricity of cans is important. A small misalignment at the beginning of the necking stages may result in concentricity problems between the can body and neck. For illustration, a difference in the centers of 0.020 inches (twenty thousandths) could result in a weak seam or even result in an insufficiently seamed can.

SUMMARY

A horizontal can necking machine assembly may include a plural of main turrets and a plural of transfer starwheels. Each main turret may include a main turret shaft, a main gear mounted proximate to an end of the main turret shaft, a pusher assembly, and a die capable of necking a can body upon actuation of the turret shaft. Each transfer starwheel may include a transfer shaft and a transfer gear mounted proximate to an end of the transfer shaft. The transfer starwheels may be located in an alternating relationship with the main turrets, and the main gears may be engaged with the transfer gears such that lines through the main gear center and the centers of opposing transfer gears form an included angle of less than 170 degrees, thereby increasing the angular range available for necking the can body. The saw tooth configuration of turret and transfer shafts that provides this included angle yields, compared with configurations defining a 180 degree included angle, increased can residence time in the operational zone for a given rotational speed, which increased time enables longer or slower spindle stroke, and/or higher can throughput for a given residence time, or a combination thereof. In this regard, the main turrets and transfer starwheels may be operative to neck and move at least 2800 cans per minute, and each pusher assembly may have a stroke length relative to the die that is at least 1.5 inches, and preferably 3400 cans per minute at a stroke length of 1.75 inches.

A die for necking a can body may include a neck portion, a body portion, and a transition portion. The necking portion may have an inner wall that defines a cylinder having a first diameter. The body portion may have an inner wall that defines a cylinder having a second diameter. The transition portion may have an inner wall that smoothly transitions from the inner wall of the neck portion to the inner wall of the body portion. The first diameter is larger than the second diameter, and the neck portion is at least 0.125 inches long, and preferably 0.375 inches long.

DETAILED DESCRIPTION OF ILLUSTRATIVE EMBODIMENTS

A preferred configuration for driving a multi-stage can necking machine is provided. The multi-stage can necking machine incorporates technology that overcomes the many shortcomings of known multi-stage can necking machines. The present invention is not limited to the disclosed configuration, but rather encompasses use of the technology disclosed, in any manufacturing application according to the language of the claims.

Figure 1:
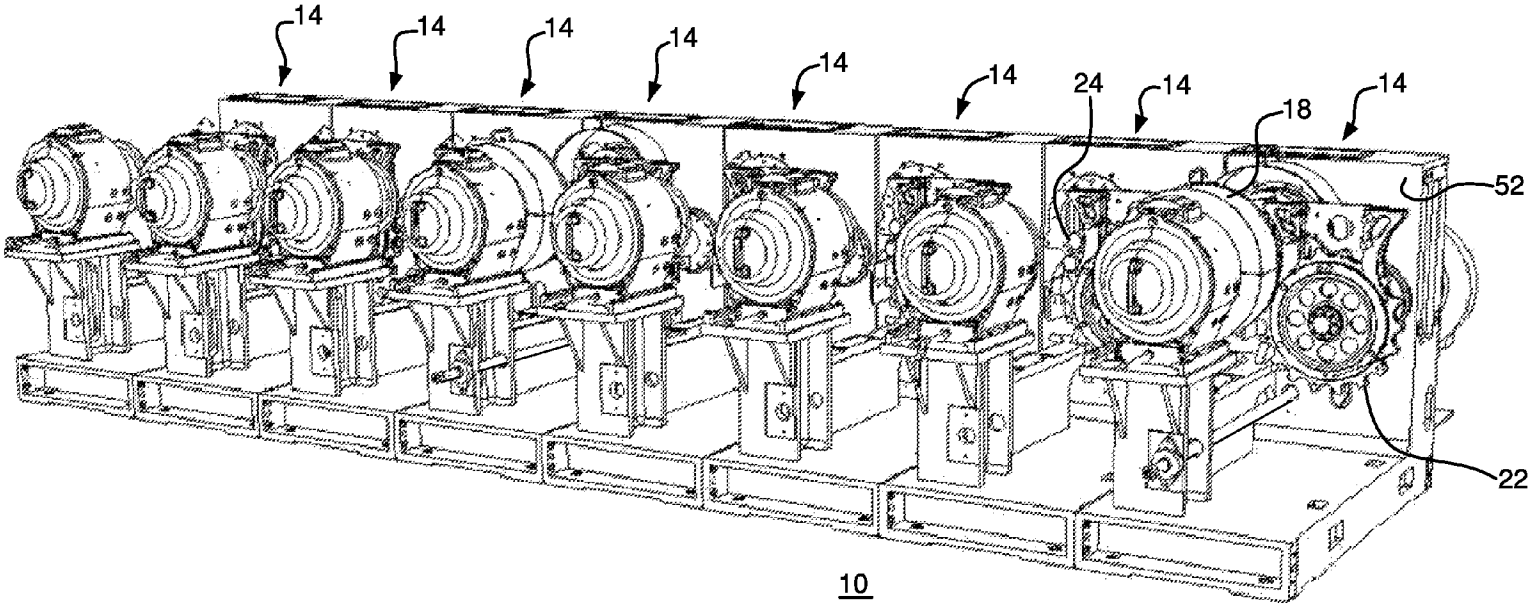
FIG. 1 is a perspective view depicting a multi-stage can necking machine.

As shown in FIG. 1, a multi-stage can necking machine 10 may include several necking stages 14. Each necking stage 14 includes a necking station 18 and a transfer starwheel 22. Each one of the necking stations 18 is adapted to incrementally reduce the diameter of an open end of a can body, and the transfer starwheels 22 are adapted to transfer the can body between adjacent necking stations 18, and optionally at the inlet and outlet of necking machine 10. Conventional multi-stage can necking machines, in general, include an input station and a waxer station at an inlet of the necking stages, and optionally include a bottom reforming station, a flanging station, and a light testing station positioned at an outlet of the necking stages. Accordingly, multi-stage can necking machine 10, may include in addition to necking stages 14, other operation stages such as an input station, a bottom reforming station, a flanging station, and a light testing station of the type that are found in conventional multi-stage can necking machines (not shown). The term "operation stage" or "operation station" and its derivative is used herein to encompass the necking station 14, bottom reforming station, a flanging station, and a light testing station, and the like. Preferably, multi-stage can necking machine 10 is operative to neck and move at least 2800 cans per minute, more preferably at least 3200 cans per minute, and even more preferably at least 3400 cans per minute.

Figure 2:
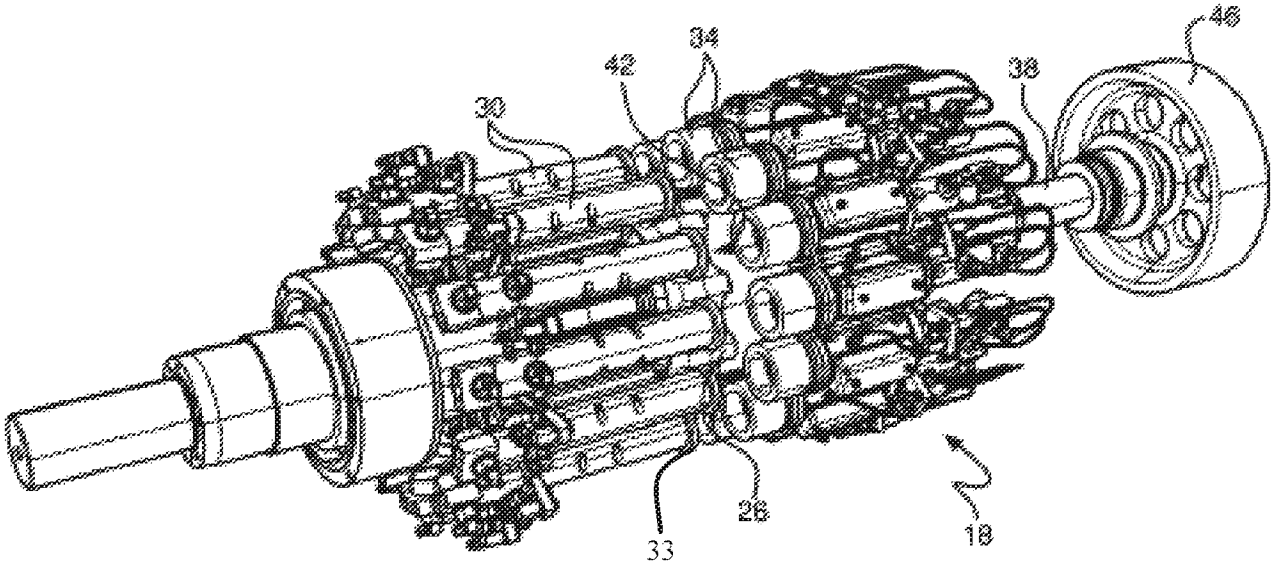
FIG. 2 is a perspective view depicting a necking station and gear mounted on a main turret shaft of the multi-stage necking machine shown in FIG. 1, with surrounding and supporting parts removed for clarity.
Figure 9A:
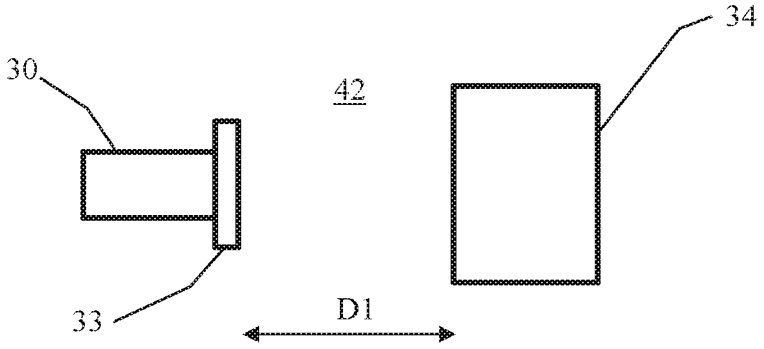
FIG. 9A (not to scale) schematically illustrates the first configuration of the pocket of the necking machine.
Figure 9B:
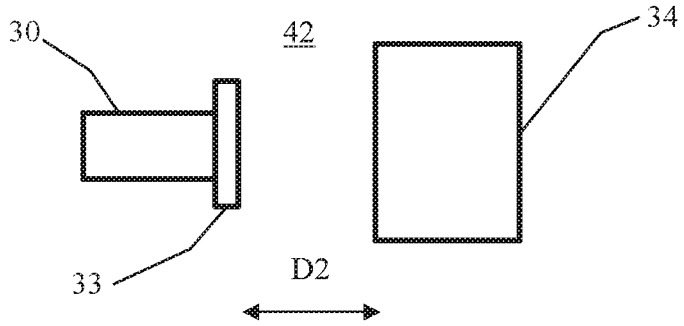
FIG. 9B (not to scale) schematically illustrates the second configuration of the pocket of the necking machine.

FIG. 2 is a detailed view depicting operative parts of one of the necking stations 18. As shown, each necking station 18 includes a main turret 26, a set of pusher rams 30, and a set of dies 34. The main turret 26, the pusher rams 30, and the dies 34 are each mounted on a main turret shaft 38. As shown, the main turret 26 has a plurality of pockets 42 formed therein. Each pocket 42 has a pusher ram 30 on one side of the pocket 42 and a corresponding die 34 on the other side of the pocket 42. FIG. 2 shows a pad 33 on one side of the pocket 42 in a first configuration in which pad 33 is spaced apart from the die 34 by a first dimension. FIG. 9A schematically illustrates the first configuration of pocket 42 in which pad 33 is spaced apart from die 34 by a first dimension D1. FIG. 9B schematically illustrates the second configuration of pocket 42 in which the pad 33 is spaced apart from die 34 by a second dimension D2, such that the difference between the first dimension D1 and second dimension D2 is based on the stroke length, as explained more fully below. In operation, each pocket 42 is adapted to receive a can body and securely holds the can body in place by mechanical means, such as by the action pusher ram and the punch and die assembly, and compressed air, as is understood in the art. During the necking operation, the open end of the can body is brought into contact with the die 34 by the pusher ram 30 as the pocket 42 on main turret 26 carries the can body through an arc along a top portion of the necking station 18.

Die 34, in transverse cross section, is typically designed to have a lower cylindrical surface with a dimension capable of receiving the can body, a curved or angled transition zone, and a reduced diameter (relative to the lower cylindrical surface) upper cylindrical surface above the transition zone. During the necking operation, the can body is moved up into die 34 such that the open end of the can body is placed into touching contact with the transition zone of die 34. As the can body is moved further upward into die 34, the upper region of the can body is forced past the transition zone into a snug position between the inner reduced diameter surface of die 34 and a form control member or sleeve located at the lower portion of pusher ram 30. The diameter of the upper region of the can is thereby given a reduced dimension by die 34. A curvature is formed in the can wall corresponding to the surface configuration of the transition zone of die 34. The can is then ejected out of die 34 and transferred to an adjacent transfer starwheel. U.S. Pat. No. 6,094,961, which is incorporated herein by reference, discloses an example necking die used in can necking operations.

As best shown in FIG. 2, a main turret gear 46 (shown schematically in FIG. 2 without teeth) is mounted proximate to an end of shaft 38. The gear 46 may be made of suitable material, and preferably is steel.

Figure 3:
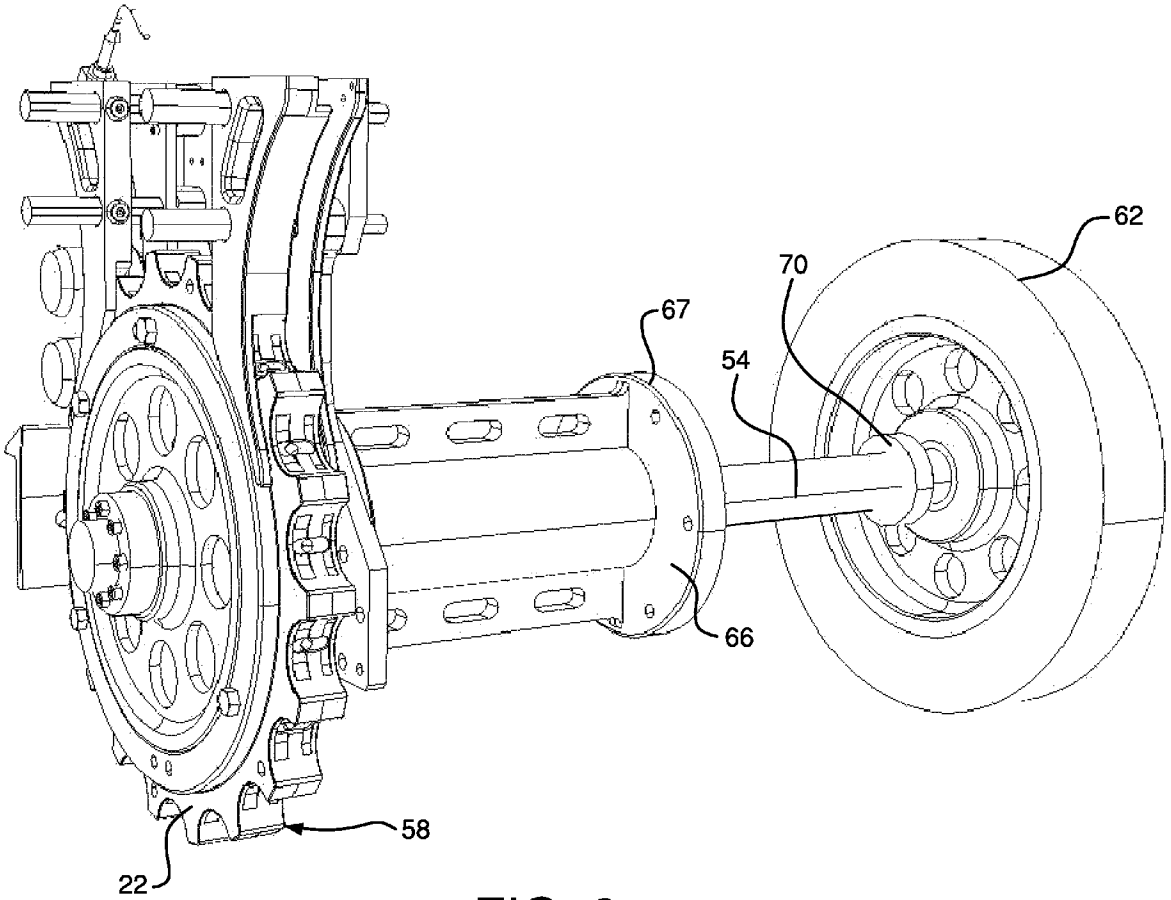
FIG. 3 is a perspective view depicting a transfer starwheel and gear mounted on a starwheel shaft of the multi-stage necking machine shown in FIG. 1, with surrounding and supporting parts removed for clarity.

As shown in FIG. 3, each starwheel 22 may be mounted on a shaft 54, and may include several pockets 58 formed therein. The starwheels 22 may have any amount of pockets 58. For example each starwheel 22 may include twelve pockets 58 or even eighteen pockets 58, depending on the particular application and goals of the machine design. Each pocket 58 is adapted to receive a can body and retains the can body using a vacuum force. The vacuum force should be strong enough to retain the can body as the starwheel 22 carries the can body through an arc along a bottom of the starwheel 22.

As shown, a gear 62 (shown schematically in FIG. 3 without teeth) is mounted proximate to an end of the shaft 54. Gear 62 may be made of steel but preferably is made of a composite material. For example, each gear 62 may be made of any conventional material, such as a reinforced plastic, such as Nylon 12.

As also shown in FIG. 3, a horizontal structural support 66 supports transfer shaft 54. Support 66 includes a flange at the back end (that is, to the right of FIG. 3) for bolting to an upright support of the base of machine 10 and includes a bearing (not shown in FIG. 3) near the front end inboard of the transfer starwheel 22. Accordingly, transfer starwheel shaft 54 is supported by a back end bearing 70 that preferably is bolted to upright support 52 and a front end bearing that is supported by horizontal support 66, which itself is cantilevered from upright support 52. Preferably the base and upright support 52 is a unitary structure for each operation stage.

Figure 4:
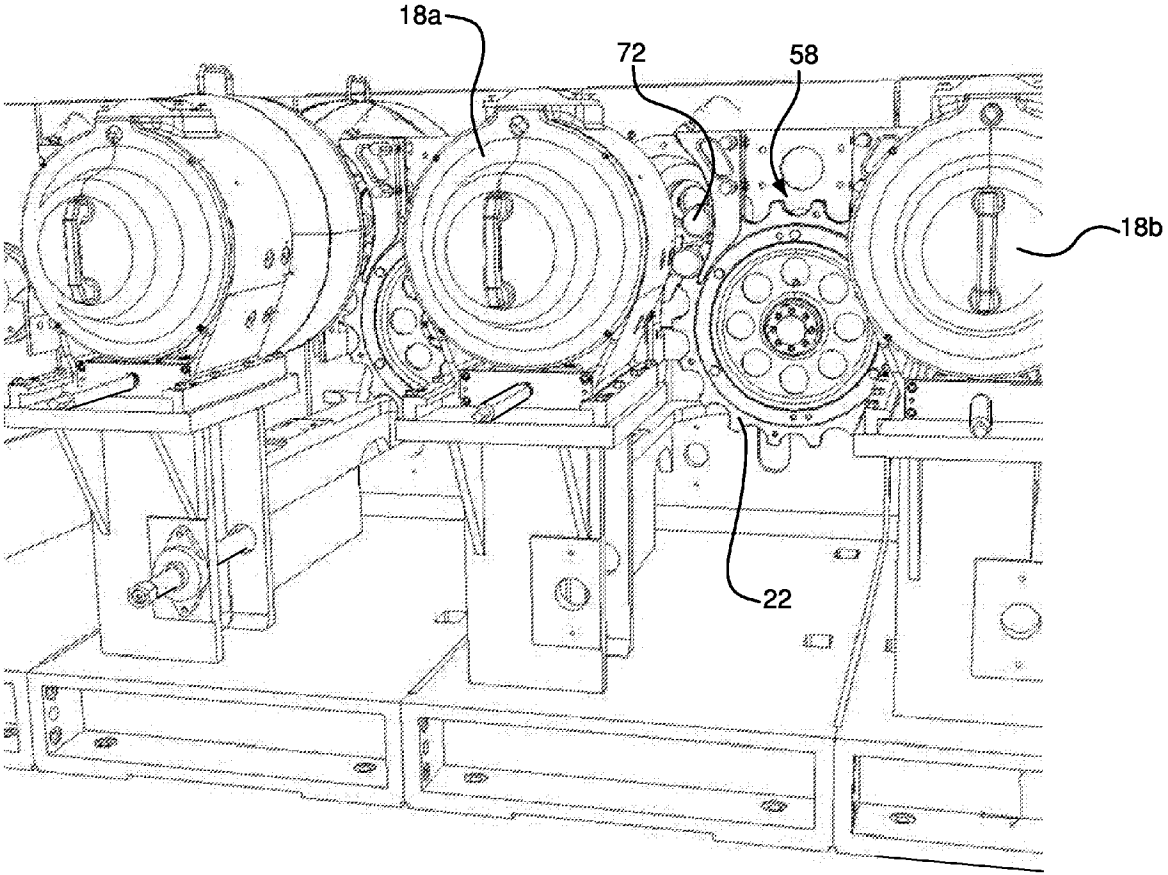
FIG. 4 is a partial expanded view depicting a section of the multi-stage can necking machine shown in FIG. 1.

FIG. 4 illustrates a can body 72 exiting a necking stage and about to transfer to a transfer starwheel 22. After the diameter of the end of a can body 72 has been reduced by the first necking station 18*a* shown in the middle of FIG. 4, main turret 26 of the necking station 18*a* deposits the can body into a pocket 58 of the transfer starwheel 22. The pocket 58 then retains the can body 72 using a vacuum force that is induced into pocket 58 from the vacuum system described in co-pending application no. 12/108,950, which is incorporated herein by reference in its entirety, carries the can body 72 through an arc over the bottommost portion of starwheel 22, and deposits the can body 72 into one of the pockets 42 of the main turret 26 of an adjacent necking station 18*b*. The necking station 18*b* further reduces the diameter of the end of the can body 72 in a manner substantially identical to that noted above.

Machine 10 may be configured with any number of necking stations 18, depending on the original and final neck diameters, material and thickness of can 72, and like parameters, as understood by persons familiar with can necking technology. For example, multi-stage can necking machine 10 illustrated in the figures includes eight stages 14, and each stage incrementally reduces the diameter of the open end of the can body 72 as described above.

Figure 5:
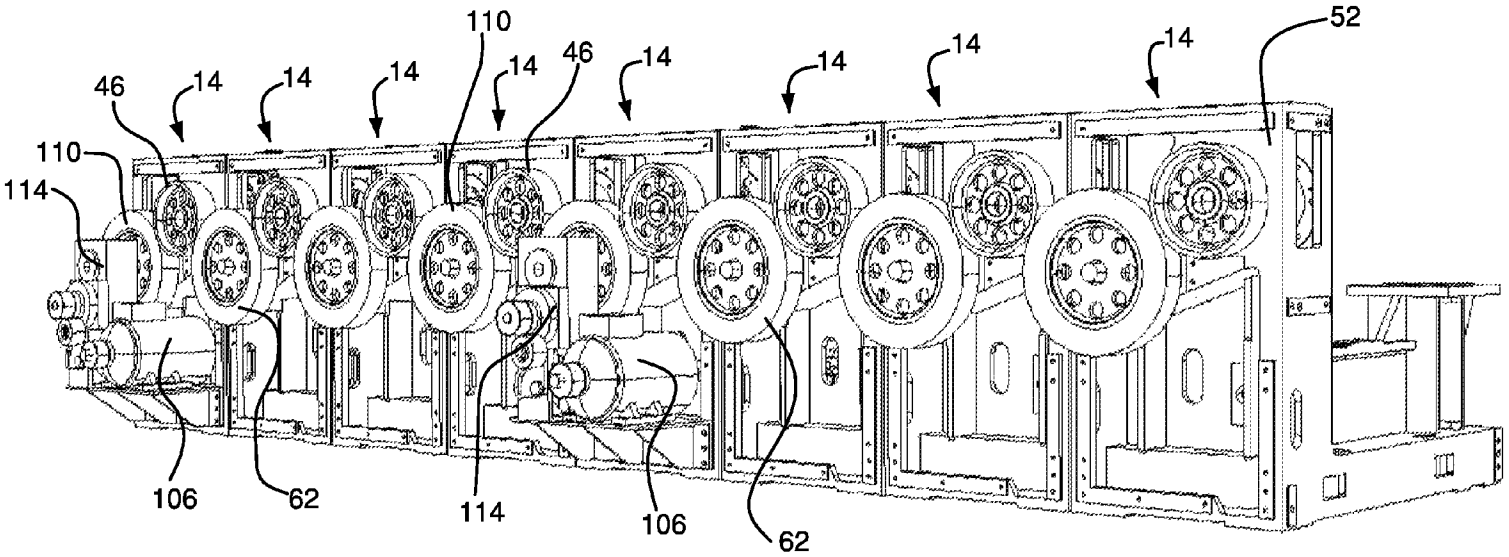
FIG. 5 is a perspective view depicting a back side of a multi-stage can necking machine having distributed drives.

As shown in FIG. 5, when the shafts 38 and 54 are supported near their rear ends by upright support 52, and the ends of the shafts 38 and 54 preferably are cantilevered such that the gears 46 and 62 are exterior to the supports 52. A cover (not shown) for preventing accidental personnel contact with gears 46 and 62, may be located over gears 46 and 62. As shown, the gears 46 and 62 are in mesh communication to form a continuous gear train. The gears 46 and 62 preferably are positioned relative to each other to define a zig-zag or saw tooth configuration. That is, the main gears 46 are engaged with the transfer starwheel gears 62 such that lines through the main gear 46 center and the centers of opposing transfer starwheel gears 62 form an included angle of less than 170 degrees, preferably approximately 120 degrees, thereby increasing the angular range available for necking the can body. In this regard, because the transfer starwheels 22 have centerlines below the centerlines of main turrets 26, the operative portion of the main turret 26 (that is, the arc through which the can passes during which the necking or other operation can be performed) is greater than 180 degrees on the main turret 26, which for a given rotational speed provides the can with greater time in the operative zone. Accordingly the operative zone has an angle (defined by the orientation of the centers of shafts 38 and 54) greater than about 225 degrees, and even more preferably, the angle is greater than 240 degrees. The embodiment shown in the figures has an operative zone having an angle of 240 degrees. In general, the greater the angle that defines the operative zone, the greater the angular range available for necking the can body.

In this regard, for a given rotational speed, the longer residence time of a can in the operative zone enables a longer stroke length for a given longitudinal speed of the pusher ram. For example, with the above identified configuration, the pusher ram 30 may have a stroke length relative to the die 34 of at least 1.5 inches. Preferably, the pusher ram 30 will have a stroke length relative to the die 34 of at least 1.625 inches and even more preferably the stroke length is at least 1.75 inches. For the embodiment shown in the figures, the stroke length is approximately 1.75 inches.

Figure 6A:
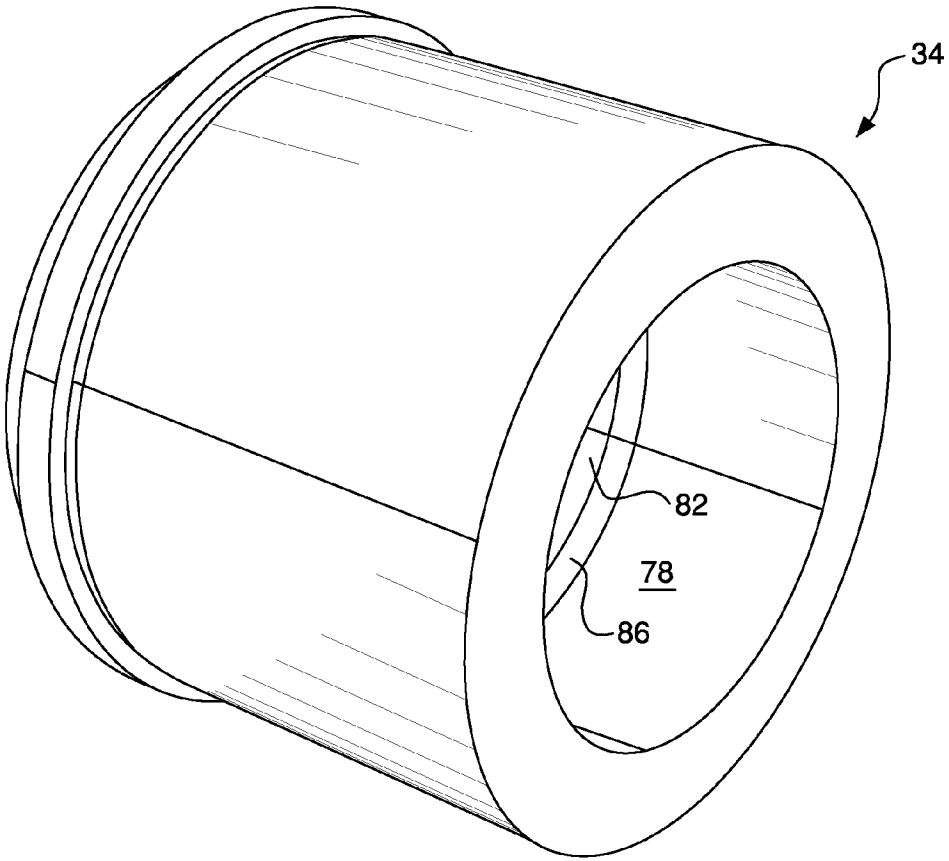
FIG. 6A is a perspective view depicting a forming die.
Figure 6B:
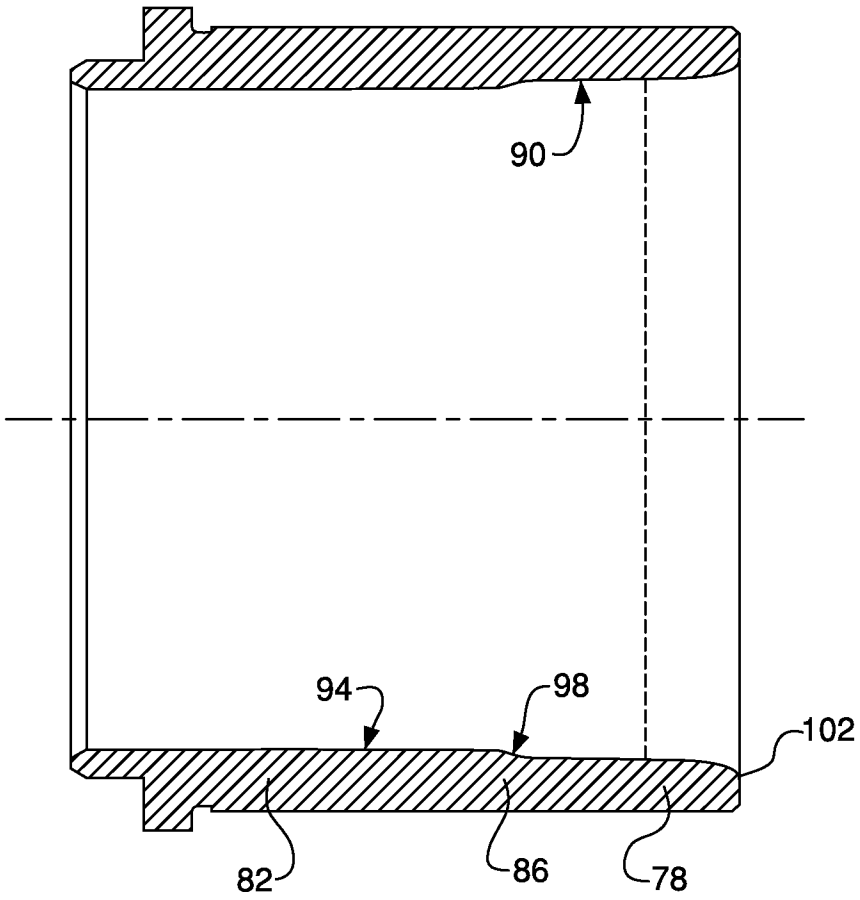
FIG. 6B is a cross-sectional view of the forming die depicted in FIG. 6A.

The angular range available for necking of greater than 180 degrees enables the die used to reduce the diameter of the end of the can body to be designed to improve the concentricity of the can end. As shown in FIGS. 6A and 6B, the die 34 includes a throat portion 78, a body portion 82 and a transition portion 86. As shown, the throat portion 78 has an inner surface 90 that defines a cylinder having a first diameter, the body portion 82 has an inner surface 94 that defines a cylinder having a second diameter, and the transition portion 86 has an inner surface 98 that extends smoothly (and maybe curved) from the inner surface 90 of the throat portion 78 to the inner surface 94 of the body portion 82. The first diameter should be large enough to receive the can body and the second diameter should be sized so that the diameter of the end of the can body can be reduced to a desired diameter.

To help improve the concentricity of the can end the throat portion preferably has a length of at least 0.125 inches, more preferably a length of at least 0.25 inches and even more preferably a length of at least 0.375 inches. The embodiment illustrated in the figures has a throat length of approximately 0.375 inches. Furthermore, an inlet 102 of the throat portion 78 may be rounded.

During operation of conventional stroke machines, the first part of the can that touches the die is the neck or necked rim. Any error in the neck portion often becomes worse, throughout the necking stages. In the long stroke machine illustrated herein, when the can goes into the die, it first locates itself in the die before it touches the transition portion. Therefore, by having a longer throat portion 78 compared with the prior art, the die 34 is able to center the can body prior to necking. Additionally, by having a longer throat portion 78, the die 34 is able to seal the compressed air sooner. Until the can is sealed, the compresses air blows into the ambient atmosphere, which can be costly.

Referring back to FIG. 5, the multi-stage can necking machine 10 may include several motors 106 to drive the gears 46 and 62 of each necking stage 14. As shown, there preferably is one motor 106 per every four necking stages 14, as generally described in copending application no. 12/109,058. Each motor 106 is coupled to and drives a first gear 110 by way of a gear box 114. The motor driven gears 110 then drive the remaining gears of the gear train. By using multiple motors 106, the torque required to drive the entire gear train can be distributed throughout the gears, as opposed to prior art necking machines that use a single motor to drive the entire gear train. In the prior art gear train that is driven by a single gear, the gear teeth must be sized according to the maximum stress. Because the gears closest to the prior art drive gearbox must transmit torque to the entire gear train (or where the single drive is located near the center on the stages, must transmit torque to about half the gear train), the maximum load on prior art gear teeth is higher than the maximum tooth load of the distributed gearboxes according to the present invention. The importance in this difference in tooth loads is amplified upon considering that the maximum loads often occur in emergency stop situations. A benefit of the lower load or torque transmission of gears 46 and 62 compared with that of the prior art is that the gears can be more readily and economically formed of a reinforced thermoplastic or composite, as described above. Lubrication of the synthetic gears can be achieved with heavy grease or like synthetic viscous lubricant, as will be understood by persons familiar with lubrication of gears of necking or other machines, even when every other gear is steel as in the presently illustrated embodiment. Accordingly, the gears are not required to be enclosed in an oil-tight chamber or an oil bath, but rather merely require a minimal protection against accidental personnel contact Each motor 106 is driven by a separate inverter which supplies the motors 106 with current. To achieve a desired motor speed, the frequency of the inverter output is altered, typically between zero to 50 (or 60 hertz). For example, if the motors 106 are to be driven at half speed (that is, half the rotational speed corresponding to half the maximum or rated throughput) they would be supplied with 25 Hz (or 30 Hz).

In the case of the distributed drive configuration shown herein, each motor inverter is set at a different frequency.

Figure 7:
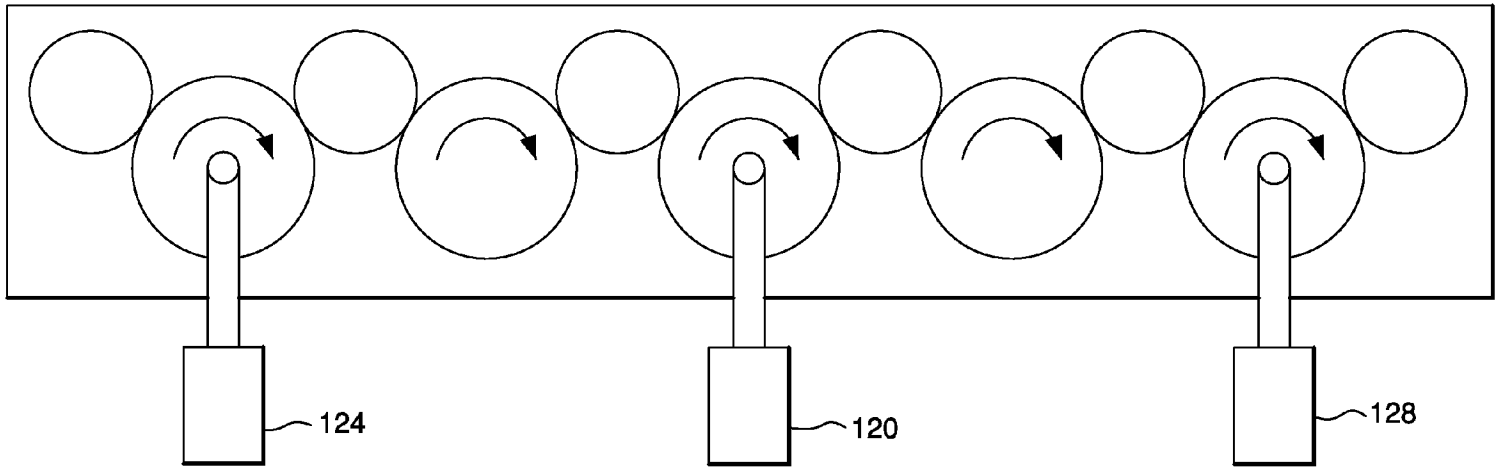
FIG. 7 is a schematic illustrating a machine having distributed drives.

Referring to FIG. 7 for example, a second motor 120 may have a frequency that is approximately 0.02 Hz greater than the frequency of a first motor 124, and a third motor 128 may have a frequency that is approximately 0.02 Hz greater than the frequency of the second motor 120. It should be understood that the increment of 0.02 Hz may be variable, however, it will be by a small percentage (in this case less than 1%).

Figure 8:
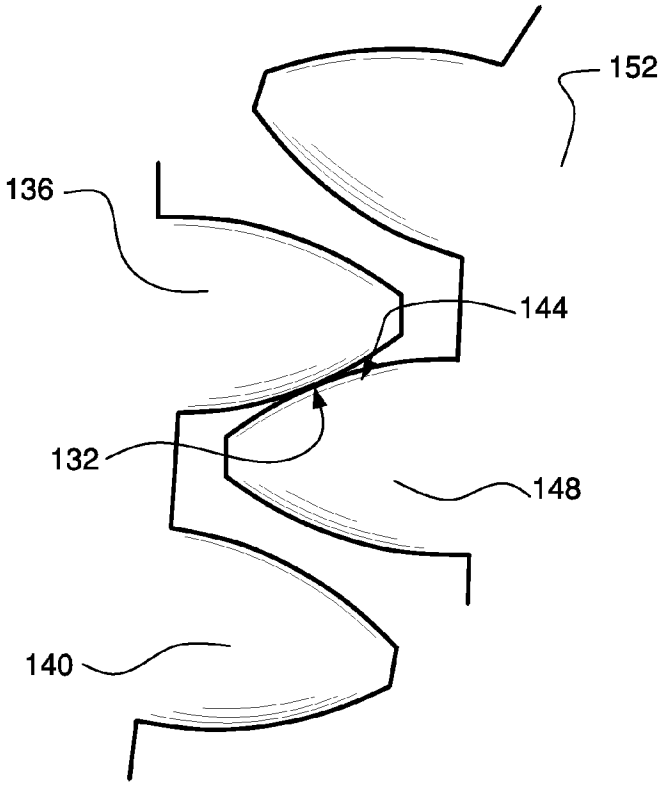
FIG. 8 is a partial expanded view depicting gear teeth from adjacent gears engaging each other.

The downstream motors preferably are preferably controlled to operate at a slightly higher speed to maintain contact between the driving gear teeth and the driven gear teeth throughout the gear train. Even a small freewheeling effect in which a driven gear loses contact with its driving gear could introduce a variation in rotational speed in the gear or misalignment as the gear during operation would not be in its designed position during its rotation. Because the operating turrets are attached to the gear train, variations in rotational speed could produce misalignment as a can 72 is passed between starwheel and main turret pockets and variability in the necking process. The actual result of controlling the downstream gears to operate a slightly higher speed is that the motors 120, 124, and 128 all run at the same speed, with motors 120 and 128 "slipping," which should not have any detrimental effect on the life of the motors. Essentially, motors 120 and 128 are applying more torque, which causes the gear train to be "pulled along" from the direction of motor 128. Such an arrangement eliminates variation in backlash in the gears, as they are always contacting on the same side of the tooth, as shown in FIG. 8. As shown in FIG. 8, a contact surface 132 of a gear tooth 136 of a first gear 140 may contact a contact surface 144 of a gear tooth 148 of a second gear 152. This is also true when the machine starts to slow down, as the speed reduction is applied in the same way (with motor 128 still being supplied with a higher frequency). Thus "chattering" between the gears when the machine speed changes may be avoided.

In the case of a machine using one motor, reductions in speed may cause the gears to drive on the opposite side of the teeth. It is possible that this may create small changes in the relationship between the timing of the pockets passing cans from one turret to the next, and if this happens, the can bodies may be dented.

The present invention has been described by illustrating preferred embodiments. The present invention is not limited to an configuration or dimensions provided in the specification, but rather should be entitled to the full scope as defined in the claims.

What is claimed:

1. A horizontal beverage can necking machine assembly for forming necked beverage can bodies suitable for forming a seam with a beverage can end, the assembly comprising:

multiple horizontal necking stages adapted for necking at least 3000 beverage can bodies per minute, each necking stage being configured to rotate about a respective axis that is substantially parallel to a surface on which the necking machine is supported;

the longitudinal centers of the adjacent necking stages forming an included angle with the longitudinal center of a transfer starwheel, measured with the longitudinal center of the transfer starwheel at the vertex, of no more than 170 degrees;

each one of the necking stages including a main turret that includes: a main turret shaft, a main turret starwheel having plural pockets adapted for carrying can bodies, and a main gear mounted on the main turret shaft; each one of the pockets having a necking die at one end thereof and a pad on an opposing end;

each necking die of each one of the necking stages comprising:

a throat portion that is at least 0.125 inches long;

a body portion having an inner dimension that is smaller than an inner dimension of the throat portion; and a transition portion having an inner surface that smoothly transitions from an inner surface of the throat portion to an inner surface of the body portion; and each one of the pockets of each one of the necking stages having a first configuration in which the can body is spaced apart from the necking die and a second configuration in which the can body is engaged with the necking die; in the first configuration the pad is spaced apart from the necking die by a first distance, in the second configuration the pad is spaced apart from the necking die by a second distance that is at least 1.5 inches less than the first distance.

2. The necking machine assembly of claim 1 wherein the throat portion inner surface defines a cylinder having a diameter that is the throat portion inner dimension, the body portion inner surface defines a cylinder having a diameter that is the body portion inner dimension.

3. The necking machine assembly of claim 1 wherein the second distance is at least 1.625 inches less than the first distance.

4. The necking machine assembly of claim 1 wherein the second distance is at least 1.75 inches less than the first distance.

5. The necking machine assembly of claim 1 wherein the necking stages are adapted for necking at least 3200 beverage can bodies per minute.

6. The necking machine assembly of claim 1 wherein the necking stages are adapted for necking at least 3400 can bodies per minute.

7. The necking machine assembly of claim 1 wherein the throat portion of each necking die is at least 0.25 inches long.

8. The necking machine assembly of claim 1 wherein the throat portion of each necking die is at least 0.375 inches long.

9. The necking machine assembly of claim 1 wherein the pad is part of a pusher assembly adapted for moving the pad toward the necking die.

10. The necking machine assembly of claim 1 wherein the included angle is no more than 120 degrees.

11. A horizontal beverage can necking machine assembly for forming necked beverage can bodies suitable for forming a seam with a beverage can end, the assembly comprising:

multiple horizontal necking stages adapted for necking at least 3000 beverage can bodies per minute, each necking stage being configured to rotate about a respective axis that is substantially parallel to a surface on which the necking machine is supported;

the longitudinal centers of the adjacent necking stages forming an included angle with the longitudinal center of a transfer starwheel, measured with the longitudinal center of the transfer starwheel at the vertex, of no more than 170 degrees;

each one of the necking stages including a main turret that includes: a main turret shaft, a main turret starwheel having plural pockets adapted for carrying can bodies, and a main gear mounted on the main turret shaft; each one of the pockets having a necking die at one end thereof and a pad on an opposing end;

each necking die comprising:

a throat portion that is at least 0.125 inches long;

a body portion having an inner dimension that is smaller than an inner dimension of the throat portion; and a transition portion having an inner surface that smoothly transitions from an inner surface of the throat portion to an inner surface of the body portion;

each one of the pockets having a first configuration in which the can body is spaced apart from the die and a second configuration in which the can body is engaged with the necking die throat portion;

whereby the throat portion inner surface is adapted for enhancing concentricity of the can body relative to the die.

12. The necking machine assembly of claim 11 wherein the throat portion inner surface defines a cylinder having a diameter that is the throat portion inner dimension, the body portion inner surface defines a cylinder having a diameter that is the body portion inner dimension.

13. The necking machine assembly of claim 11 wherein the necking stages are adapted for necking at least 3200 beverage can bodies per minute.

14. The necking machine assembly of claim 11 wherein the necking stages are adapted for necking at least 3400 can bodies per minute.

15. The necking machine assembly of claim 11 wherein the throat portion of each necking die is at least 0.25 inches long.

16. The necking machine assembly of claim 11 wherein the throat portion of each necking die is at least 0.375 inches long.

17. The necking machine assembly of claim 11 wherein the main turret further includes a pusher assembly for pushing the can body into the necking die.

18. The necking machine assembly of claim 11 wherein the pad is part of a pusher assembly.

19. The necking machine assembly of claim 11 wherein the included angle is no more than assembly 120 degrees.

20. A horizontal beverage can necking machine for forming necked beverage can bodies suitable for forming a seam with a beverage can end, the assembly comprising:

multiple horizontal necking stages adapted for necking at least 3000 beverage can bodies per minute, each necking stage being configured to rotate about a respective axis that is substantially parallel to a surface on which the necking machine is supported;

the longitudinal centers of the adjacent necking stages forming an included angle with the longitudinal center of a transfer starwheel, measured with the longitudinal center of the transfer starwheel at the vertex, of no more than 170 degrees;

each one of the necking stages including a main turret that includes: a main turret shaft, a main turret starwheel having plural pockets adapted for carrying can bodies, and a main gear mounted on the main turret shaft; each one of the pockets having a necking die at one end thereof and a pad on an opposing end;

each necking die comprising:

a throat portion having an inner surface that defines a cylinder having a throat portion diameter;

a body portion having an inner surface that defines a cylinder having a body portion diameter; and a transition portion having an inner surface that smoothly transitions from the inner surface of the throat portion to the inner surface of the body portion, wherein the throat portion diameter is larger than the body portion diameter; and each one of the pockets of each one of the necking stages having a first configuration in which the can body is spaced apart from the necking die and a second configuration in which the can body is engaged with the necking die; in the first configuration the pad is spaced apart from the necking die by a first distance, in the second configuration the pad is spaced apart from the necking die by a second distance that is at least 1.5 inches less than the first distance;

whereby the throat portion inner surface is adapted for enhancing concentricity of the can body relative to the die.

21. The necking machine assembly of claim 20 wherein the second distance is at least 1.625 inches less than the first distance.

22. The necking machine assembly of claim 20 wherein the second distance is at least 1.75 inches less than the first distance.

23. The necking machine assembly of claim 20 wherein the necking stages are adapted for necking at least 3200 beverage can bodies per minute.

24. The necking machine assembly of claim 20 wherein the necking stages are adapted for necking at least 3400 can bodies per minute.

25. The necking machine assembly of claim 20 wherein the pad is part of a pusher assembly adapted for moving the pad toward the necking die.

26. The necking machine assembly of claim 20 wherein the included angle is no more than 120 degrees.

* * * * *